US009629441B2

(12) United States Patent
Schaller et al.

(10) Patent No.: US 9,629,441 B2
(45) Date of Patent: Apr. 25, 2017

(54) WEARABLE PACKAGE FOR CONSUMABLE PRODUCTS AND METHODS FOR USING SAME

(71) Applicant: Nestec S.A., Vevey (CH)

(72) Inventors: Raphael Schaller, Newaygo, MI (US); Matthew Blake Rodgers, Grand Haven, MI (US); Joel Dean Genaw, Jr., Grand Rapids, MI (US)

(73) Assignee: Nestec S.A., Vevey (CH)

( * ) Notice: Subject to any disclaimer, the term of this patent is extended or adjusted under 35 U.S.C. 154(b) by 190 days.

(21) Appl. No.: 14/052,205

(22) Filed: Oct. 11, 2013

(65) Prior Publication Data

US 2014/0103082 A1 Apr. 17, 2014

Related U.S. Application Data

(60) Provisional application No. 61/715,189, filed on Oct. 17, 2012.

(51) Int. Cl.

| | |
|---|---|
| ***A45F 5/00*** | (2006.01) |
| ***A45F 3/14*** | (2006.01) |
| ***A44C 5/00*** | (2006.01) |
| ***A45F 3/00*** | (2006.01) |
| ***A45C 1/04*** | (2006.01) |
| ***B65D 75/52*** | (2006.01) |
| ***A45F 5/02*** | (2006.01) |

(52) U.S. Cl.

CPC ..... *A45F 3/00* (2013.01); *A45C 1/04* (2013.01); *A45F 3/14* (2013.01); *A45F 5/02* (2013.01); *B65D 75/52* (2013.01); *A44C 5/003* (2013.01); *A45F 2005/008* (2013.01)

(58) Field of Classification Search

CPC ..... A45F 3/00; A45F 2005/008; A45F 5/00
USPC ..... 224/267, 222, 219, 191, 148.2, 148.4
See application file for complete search history.

(56) References Cited

U.S. PATENT DOCUMENTS

| | | | | |
|---|---|---|---|---|
| 3,189,227 A * | 6/1965 | Hobbs | B65D 75/40 206/820 |
| 4,090,650 A * | 5/1978 | Gotta | 224/148.2 |
| 4,139,130 A * | 2/1979 | Glusker et al. | 224/148.2 |
| 4,176,772 A * | 12/1979 | Danon | 224/148.5 |
| 4,265,381 A * | 5/1981 | Muscatell | A41F 9/002 2/312 |

(Continued)

FOREIGN PATENT DOCUMENTS

| | | |
|---|---|---|
| WO | 9943566 A1 | 9/1999 |
| WO | 2005092144 A1 | 10/2005 |

OTHER PUBLICATIONS

International Search Report and Written Opinion from corresponding PCT patent application No. PCT/IB2013/059324 dated Feb. 13, 2014.

*Primary Examiner* — Lester L Vanterpool
(74) *Attorney, Agent, or Firm* — Gary M. Lobel, Esq.

(57) ABSTRACT

Wearable packages for consumable products and methods for using same are provided. In a general embodiment, the wearable packages include a first compartment for housing a product and a second compartment for housing a bi-stable band. The wearable packages provide several advantages and benefits including, but not limited to convenient carrying and handling of consumable products and easy two-, one-, or no-handed access to products contained within the wearable packages.

20 Claims, 4 Drawing Sheets

(56) References Cited

U.S. PATENT DOCUMENTS 4,462,116 A * 7/1984 Sanzone ..... A45C 1/04 2/160
4,576,169 A * 3/1986 Williams ..... A61F 7/10 607/109
4,736,876 A * 4/1988 Kriss ..... A45C 1/04 222/175
4,762,821 A * 8/1988 Nestor ..... 514/16.2
4,763,821 A * 8/1988 Powell ..... A45C 1/04 224/222
4,905,881 A * 3/1990 Graber ..... A45C 1/04 150/131
4,988,097 A * 1/1991 Smith ..... A45C 1/04 224/148.2
5,305,470 A * 4/1994 McKay ..... A41D 20/005 2/170
5,341,972 A * 8/1994 Jacks ..... 224/165
5,671,481 A * 9/1997 Giard ..... A45C 1/04 2/170
5,839,609 A * 11/1998 Zakensberg ..... B65D 75/32 206/484
5,938,089 A * 8/1999 Abreu-Marston ..... A45F 3/20 215/382
5,957,347 A * 9/1999 White ..... A45F 3/20 222/175
6,126,041 A * 10/2000 DiTomasso ..... A45F 3/20 222/175
6,200,243 B1 * 3/2001 Meranto ..... 482/105
6,227,424 B1 * 5/2001 Roegner ..... A45C 1/04 150/131
6,349,414 B1 * 2/2002 Tillman ..... A41D 20/00 2/170
6,443,341 B1 * 9/2002 Rittmann ..... A45C 1/04 150/149
6,598,770 B2 * 7/2003 Bolts ..... 224/148.2
7,735,682 B1 * 6/2010 Cassel et al. ..... 221/185
8,453,893 B2 * 6/2013 Shitaye ..... 224/148.2
8,622,262 B2 * 1/2014 Van Art ..... 224/148.2
9,089,190 B2 * 7/2015 Booker ..... A44C 5/0023
2004/0264816 A1 * 12/2004 Carter ..... B65D 75/5811 383/207
2005/0105831 A1 * 5/2005 Weber ..... B65B 3/045 383/40
2008/0047990 A1 * 2/2008 Morgan et al. ..... 224/222
2008/0151695 A1 6/2008 Kimel
2008/0216847 A1 * 9/2008 Demmer ..... A24C 5/40 131/70
2010/0237115 A1 * 9/2010 Booker ..... A44C 5/0023 224/267
2010/0258601 A1 * 10/2010 Thrope ..... A45C 1/00 224/267
2011/0167536 A1 * 7/2011 Kellerhals ..... 2/170
2011/0185611 A1 * 8/2011 Adams ..... A44C 5/00 40/633
2012/0048898 A1 * 3/2012 Franklin ..... A45F 3/20 224/148.2

* cited by examiner

WEARABLE PACKAGE FOR CONSUMABLE PRODUCTS AND METHODS FOR USING SAME

BACKGROUND

The present disclosure relates generally to packaging. More specifically, the present disclosure relates to wearable packaging for consumable products and methods for using same.

There are many different types of packages for consumable products currently available in the market. Known packages include, for example, cardboard boxes, plastic bottles, plastic sachets, paper bags, etc. Different types of known packages have advantages and disadvantages, depending on the intended use of the package. For example, cardboard boxes are lightweight, recyclable and easily compacted. On the contrary, cardboard boxes cannot contain liquids or gels, are not as sturdy as plastic packaging, and have a poor packing density for any solids that are not substantially square or rectangular in shape.

Further, consumption of any consumable product(s) within, for example, a cardboard box typically requires a two-handed approach since it is difficult to directly dispense a product from a box into the consumer's mouth. Indeed, most product packages on the market require one hand for holding the package and the other hand for dispensing the product into the consumer's mouth. Even if the package is designed for direct dispensation into the consumer's mouth, it may still be inconvenient for the consumer to have to carry the package in his or her hand(s) prior to or during consumption. This is especially true when the consumer is engaged in an activity that requires at least one, if not two, free hands such as, for example, various athletic endeavors.

There exists a need, therefore, for consumable products packages that are easily transported, held or carried, and that are designed for ease of consumption by the consumer.

SUMMARY

The present disclosure is directed to wearable packages and methods for using same. In a general embodiment, a wearable package is provided and includes a first compartment for housing a product and a second compartment for housing a bi-stable band.

In an embodiment, the package is so constructed and arranged to be worn by a consumer.

In an embodiment, the package is so constructed and arranged to be worn on a body part selected from the group consisting of a wrist, an ankle, a waist, a neck, a finger, or combinations thereof.

In an embodiment, the package is so constructed and arranged to be worn on a piece of clothing selected from the group consisting of a watch, a belt, a scarf, a pet collar, a shoe, a headband, a wrist band, or combinations thereof.

In an embodiment, the consumer is selected from the group consisting of an athlete, a parent, a child, a pet, an academic, or combinations thereof.

In an embodiment, the package is a slap bracelet.

In an embodiment, the bi-stable band is made of a material selected from the group consisting of plastic, metal, or combinations thereof. The bi-stable band may be a substantially flat band and may be from about 2 to about 10 inches long, or from about 3 to about 9 inches long, or from about 4 to about 8 inches long, or from about 5 to about 7 inches long, or about 6 inches long. The package may also be from about 0.5 to about 4 inches in width, or from about 1 to about 3 inches in width, or about 2 inches in width.

In an embodiment, the first compartment has a volume from about 0.5 ounces to about 5 ounces, or from about 1 ounces to about 4 ounces, or from about 2 ounces to about 3 ounces, or about 1.4 ounces, or about 2.5 ounces.

In an embodiment, the first compartment is so constructed and arranged to house a solid product, a liquid product, a semi-solid product, or combinations thereof.

In an embodiment, the first compartment includes at least one opening element selected from the group consisting of a perforation, a tear line, a one-way valve, or combinations thereof.

In an embodiment, the first compartment is divided into at least two separate portions. The at least two separate portions may have the same sizes or different sizes. The at least two separate portions may be constructed and arranged to house the same product or different products.

In an embodiment, the first compartment is refillable.

In an embodiment, the first and second compartments are formed from one piece of material. The first and second compartments may also be formed from separate materials and adjoined during manufacturing. The first and second compartments may be adjoined using an adhesive.

In an embodiment, the first and second compartments are contiguous.

In an embodiment, the first and second compartments are substantially the same size, but may also be different sizes. The first and second compartments may also be the same shape or different shapes.

In an embodiment, the package includes an indicia on an exterior surface.

In another embodiment, a wearable package is provided and includes a first compartment for housing a product and a second compartment having an elongated opening for accepting a bi-stable band.

In an embodiment, the elongated opening is sized and shaped to accept the bi-stable band.

In an embodiment, the package is reusable.

In an embodiment, the package is so constructed and arranged to be worn by a consumer.

In an embodiment, the package is so constructed and arranged to be worn on a body part selected from the group consisting of a wrist, an ankle, a waist, a neck, a finger, or combinations thereof.

In an embodiment, the package is so constructed and arranged to be worn on a piece of clothing selected from the group consisting of a watch, a belt, a scarf, a pet collar, a shoe, a headband, a wrist band, or combinations thereof.

In an embodiment, the consumer is selected from the group consisting of an athlete, a parent, a child, a pet, an academic, or combinations thereof.

In an embodiment, the package is a slap bracelet.

In an embodiment, the bi-stable band is made of a material selected from the group consisting of plastic, metal, or combinations thereof. The bi-stable band may be a substantially flat band and may be from about 2 to about 10 inches long, or from about 3 to about 9 inches long, or from about 4 to about 8 inches long, or from about 5 to about 7 inches long, or about 6 inches long. The package may also be from about 0.5 to about 4 inches in width, or from about 1 to about 3 inches in width, or about 2 inches in width.

In an embodiment, the first compartment has a volume from about 0.5 ounces to about 5 ounces, or from about 1 ounces to about 4 ounces, or from about 2 ounces to about 3 ounces, or about 1.4 ounces, or about 2.5 ounces.

In an embodiment, the first compartment is so constructed and arranged to house a solid product, a liquid product, a semi-solid product, or combinations thereof.

In an embodiment, the first compartment includes at least one opening element selected from the group consisting of a perforation, a tear line, a one-way valve, or combinations thereof.

In an embodiment, the first compartment is divided into at least two separate portions. The at least two separate portions may have the same sizes or different sizes. The at least two separate portions may be constructed and arranged to house the same product or different products.

In an embodiment, the first compartment is refillable.

In an embodiment, the first and second compartments are formed from one piece of material. The first and second compartments may also be formed from separate materials and adjoined during manufacturing. The first and second compartments may be adjoined using an adhesive.

In an embodiment, the first and second compartments are contiguous.

In an embodiment, the first and second compartments are substantially the same size, but may also be different sizes. The first and second compartments may also be the same shape or different shapes.

In an embodiment, the package includes an indicia on an exterior surface.

In yet another embodiment, a wearable package is provided and includes a hollow rigid container housing a consumable product. The rigid container is so constructed and arranged to be worn around an appendage of a consumer.

In an embodiment, the package is so constructed and arranged to be worn on an appendage selected from the group consisting of a wrist, an ankle, a neck, a finger, or combinations thereof.

In an embodiment, the consumer is selected from the group consisting of an athlete, a parent, a child, a pet, an academic, or combinations thereof.

In an embodiment, the package is so constructed and arranged to slide over the appendage of the consumer.

In an embodiment, the package is so constructed and arranged to be joined to a portion of itself to secure around the appendage of the consumer.

In an embodiment, the hollow container has a volume from about 0.5 ounces to about 5 ounces, or from about 1 ounces to about 4 ounces, or from about 2 ounces to about 3 ounces, or about 1.4 ounces, or about 2.5 ounces.

In an embodiment, the hollow container is so constructed and arranged to house a solid product, a liquid product, a semi-solid product, or combinations thereof.

In an embodiment, the hollow container includes at least one opening element selected from the group consisting of a perforation, a tear line, a one-way valve, or combinations thereof.

In an embodiment, the hollow container is divided into at least two separate portions. The at least two separate portions can have the same sizes, or different sizes and may be constructed and arranged to house the same product or different products.

In an embodiment, the hollow container is refillable.

In an embodiment, the hollow container is formed from one piece of material.

In an embodiment, the package comprises an indicia on an exterior surface.

In still yet another embodiment, a wearable package is provided and includes a consumable product container and at least one attachment apparatus for attaching the wearable package to one of a body part of a user and a piece of clothing of a user. The package may be disposable.

In an embodiment, the container is a flexible container.

In an embodiment, the container is a rigid container.

In an embodiment, the container is irreversibly sealed.

In an embodiment, the container is reversibly sealed.

In an embodiment, the attachment apparatus is selected from the group consisting of a strap, a tie, a buckle, a button, a clasp, or combinations thereof.

In an embodiment, the package is so constructed and arranged to be worn on a body part selected from the group consisting of a wrist, an ankle, a waist, a neck, a finger, or combinations thereof.

In an embodiment, the package is so constructed and arranged to be worn on a piece of clothing selected from the group consisting of a watch, a belt, a scarf, a pet collar, a shoe, a headband, a wrist band, or combinations thereof.

In an embodiment, the consumer is selected from the group consisting of an athlete, a parent, a child, a pet, an academic, or combinations thereof.

In an embodiment, the package is so constructed and arranged to slide over a wrist of the consumer.

In an embodiment, the package is so constructed and arranged to be joined to a portion of itself to secure around the body part of the consumer.

In an embodiment, the container has a volume from about 0.5 ounces to about 5 ounces, or from about 1 ounces to about 4 ounces, or from about 2 ounces to about 3 ounces, or about 1.4 ounces, or about 2.5 ounces.

In an embodiment, the container is so constructed and arranged to house a solid product, a liquid product, a semi-solid product, or combinations thereof.

In an embodiment, the container includes at least one opening element selected from the group consisting of a perforation, a tear line, a one-way valve, or combinations thereof.

In an embodiment, the container is divided into at least two separate portions. The at least two separate portions can have the same sizes, or different sizes and may be constructed and arranged to house the same product or different products.

In an embodiment, the container is refillable.

In an embodiment, the container is formed from one piece of material.

In an embodiment, the package comprises an indicia on an exterior surface.

In yet another embodiment, a method for administering a product to a consumer is provided. The method includes providing a wearable package having a first compartment for housing a product and a second compartment for housing a bi-stable band, instructing the consumer to wear the package, and instructing the consumer to consume the product.

In another embodiment, a method for consuming a product on-the-go is provided. The method includes wearing a wearable package having a first compartment for housing a product and a second compartment for housing a bi-stable band, opening the first compartment, and consuming the product.

In another embodiment, a method for administering a pet treat to a pet is provided. The method includes providing a wearable package having a first compartment for housing a pet treat and a second compartment for housing a bi-stable band, instructing a pet caretaker to wear the package, and instructing the pet caretaker to administer the pet treat to the pet.

In yet another embodiment, a method for administering a snack to a child is provided. The method includes providing a wearable package having a first compartment for housing a snack and a second compartment for housing a bi-stable band, instructing a child caretaker to wear the package, and instructing the child caretaker to administer the snack to the child.

In another embodiment, a method for providing nutrition to an athlete is provided. The method includes providing a wearable package having a first compartment for housing a product and a second compartment for housing a bi-stable band, instructing the athlete to wear the package, and instructing the athlete to consume the product.

In still yet another embodiment, a method for enhancing a performance of an athlete is provided. The method includes providing a wearable package having a first compartment for housing a product and a second compartment for housing a bi-stable band, instructing the athlete to wear the package, and instructing the athlete to consume the product.

In yet another embodiment, a method for improving a recovery of an athlete after an athletic event is provided. The method includes providing a wearable package having a first compartment for housing a product and a second compartment for housing a bi-stable band, instructing the athlete to wear the package, and instructing the athlete to consume the product.

In still yet another embodiment, a method for administering a product to a consumer is provided. The method includes providing a wearable package having a first compartment for housing a product and a second compartment including an elongated opening for accepting a bi-stable band, instructing the consumer to insert a bi-stable band into the elongated opening, instructing the consumer to wear the package, and instructing the consumer to consume the product.

In another embodiment, a method for consuming a product on-the-go is provided. The method includes wearing a wearable package including a first compartment for housing a product and a second compartment having an elongated opening housing a bi-stable band, opening the first compartment, and consuming the product.

In yet another embodiment, a method for administering a pet treat to a pet is provided. The method includes providing a wearable package having a first compartment for housing a pet treat and a second compartment including an elongated opening for accepting a bi-stable band, instructing a pet caretaker to insert a bi-stable band into the elongated opening, instructing the pet caretaker to wear the package, and instructing the pet caretaker to administer the pet treat to the pet.

In still yet another embodiment, a method for administering a snack to a child is provided. The method includes providing a wearable package having a first compartment for housing a snack and a second compartment including an elongated opening for accepting a bi-stable band, instructing the child caretaker to insert a bi-stable band into the elongated opening, instructing the child caretaker to wear the package, and instructing the child caretaker to administer the snack to the child.

In yet another embodiment, a method for providing nutrition to an athlete is provided. The method includes providing a wearable package having a first compartment for housing a product and a second compartment including an elongated opening for accepting a bi-stable band, instructing the athlete to insert a bi-stable band into the elongated opening, instructing the athlete to wear the package, and instructing the athlete to consume the product.

In another embodiment, a method for enhancing a performance of an athlete is provided. The method includes providing a wearable package having a first compartment for housing a product and a second compartment including an elongated opening for accepting a bi-stable band, instructing the athlete to insert a bi-stable band into the elongated opening, instructing the athlete to wear the package, and instructing the athlete to consume the product.

In still yet another embodiment, a method for improving a recovery of an athlete after an athletic event is provided. The method includes providing a wearable package having a first compartment for housing a product and a second compartment including an elongated opening for accepting a bi-stable band, instructing the athlete to insert a bi-stable band into the elongated opening, instructing the athlete to wear the package, and instructing the athlete to consume the product.

In yet another embodiment, a nutritional kit is provided. The nutritional kit includes a wearable package having a first compartment for housing a product and a second compartment including an elongated opening for accepting a bi-stable band, and a bi-stable band.

In another embodiment, a method for administering a product to a consumer is provided. The method includes providing a wearable package having a hollow rigid container housing a product, the rigid container being so constructed and arranged to be worn around an appendage of the consumer, instructing the consumer to wear the package, and instructing the consumer to consume the product.

In another embodiment, a method for consuming a product on-the-go is provided. The method includes wearing a wearable package having a hollow rigid container housing a product, the rigid container being so constructed and arranged to be worn around an appendage of a consumer, opening the hollow container, and consuming the product.

In still yet another embodiment, a method for administering a pet treat to a pet is provided. The method includes providing a wearable package having a hollow rigid container housing a pet treat, the rigid container being so constructed and arranged to be worn around an appendage of a pet caretaker, instructing the pet caretaker to wear the package, and instructing the pet caretaker to administer the pet treat to the pet.

In yet another embodiment, a method for administering a snack to a child is provided. The method includes providing a wearable package having a hollow rigid container housing the snack, the rigid container being so constructed and arranged to be worn around an appendage of a child caretaker, instructing the child caretaker to wear the package, and instructing the child caretaker to administer the snack to the child.

In another embodiment, a method for providing nutrition to an athlete is provided. The method includes providing a wearable package having a hollow rigid container housing a product, the rigid container being so constructed and arranged to be worn around an appendage of the athlete, instructing the athlete to wear the package, and instructing the athlete to consume the product.

In another embodiment, a method for enhancing a performance of an athlete is provided. The method includes providing a wearable package having a hollow rigid container housing a product, the rigid container being so constructed and arranged to be worn around an appendage of the athlete, instructing the athlete to wear the package, and instructing the athlete to consume the product.

In another embodiment, a method for improving a recovery of an athlete after an athletic event is provided. The method includes providing a wearable package having a hollow rigid container housing a product, the rigid container being so constructed and arranged to be worn around an appendage of the athlete, instructing the athlete to wear the package, and instructing the athlete to consume the product.

In another embodiment, a method for administering a product to a consumer is provided. The method includes providing a wearable package having a consumable product container housing a product, and at least one attachment apparatus for attaching the wearable package to one of a body part of the consumer and a piece of clothing of the consumer, wherein the package is disposable, instructing the consumer to wear the package, and instructing the consumer to consume the product.

In yet another embodiment, a method for consuming a product on-the-go is provided. The method includes wearing a wearable package having a consumable product container housing a product, and at least one attachment apparatus for attaching the wearable package to one of a body part of a consumer and a piece of clothing of the consumer, wherein the package is disposable, opening the container, and consuming the product.

In another embodiment, a method for administering a pet treat to a pet is provided. The method includes providing a wearable package having a consumable product container housing a pet treat, and at least one attachment apparatus for attaching the wearable package to one of a body part of a pet caretaker and a piece of clothing of the pet caretaker, wherein the package is disposable, instructing the pet caretaker to wear the package, and instructing the pet caretaker to administer the pet treat to the pet.

In still yet another embodiment, a method for administering a snack to a child is provided. The method includes providing a wearable package having a consumable product container housing a snack, and at least one attachment apparatus for attaching the wearable package to one of a body part of a child caretaker and a piece of clothing of the child caretaker, wherein the package is disposable, instructing the child caretaker to wear the package, and instructing the child caretaker to administer the snack to the child.

In another embodiment, a method for providing nutrition to an athlete is provided. The method includes providing a wearable package having a product container housing a product, and at least one attachment apparatus for attaching the wearable package to one of a body part of the athlete and a piece of clothing of the athlete, wherein the package is disposable, instructing the athlete to wear the package, and instructing the athlete to consume the product.

In another embodiment, a method for improving a recovery of an athlete after an athletic event is provided. The method includes providing a wearable package having a product container housing a product, and at least one attachment apparatus for attaching the wearable package to one of a body part of the athlete and a piece of clothing of the athlete, wherein the package is disposable, instructing the athlete to wear the package, and instructing the athlete to consume the product.

In another embodiment, a method for enhancing a performance of an athlete is provided. The method includes providing a wearable package having a product container housing a product, and at least one attachment apparatus for attaching the wearable package to one of a body part of the athlete and a piece of clothing of the athlete, wherein the package is disposable, instructing the athlete to wear the package, and instructing the athlete to consume the product.

An advantage of the present disclosure is to provide improved packages.

Another advantage of the present disclosure is to provide improved packages that are aesthetically appealing to consumers.

Another advantage of the present disclosure is to provide packages that are easily transported, held, or carried by a consumer.

Yet another advantage of the present disclosure is to provide packages that provide for easy dispensation of a product to the consumer.

Still yet another advantage of the present disclosure is to provide packages for use during athletic endeavors.

Another advantage of the present disclosure is to provide packages that allow for hands-free, convenient transportation of a composition.

Yet another advantage of the present disclosure is to provide a package for on-the-go consumption of an edible product.

Still yet another advantage of the present disclosure is to provide packages that provide hands-free access to compositions for the consumer.

Another advantage of the present disclosure is to provide methods for using improved packages.

Additional features and advantages are described herein, and will be apparent from the following Detailed Description and the figures.

DETAILED DESCRIPTION

Figure 1:
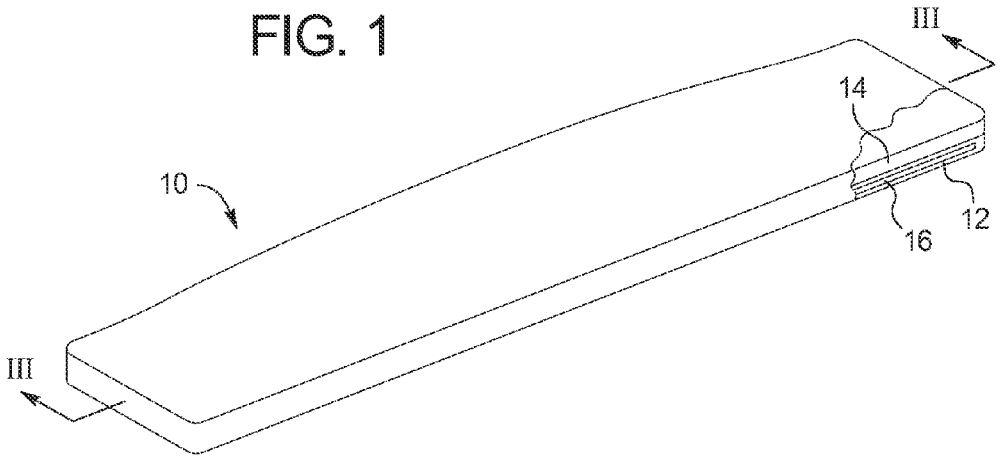
FIG. 1 is a perspective view of a package in accordance with an embodiment of the present disclosure.

As used herein, "about" is understood to refer to numbers in a range of numerals. Moreover, all numerical ranges herein should be understood to include all integer, whole or fractions, within the range.

"Nutritional products," or "nutritional compositions," as used herein, are understood to include any number of optional additional ingredients, including conventional food additives (synthetic or natural), for example one or more acidulants, additional thickeners, buffers or agents for pH adjustment, chelating agents, colorants, emulsifies, excipient, flavor agent, mineral, osmotic agents, a pharmaceutically acceptable carrier, preservatives, stabilizers, sugar, sweeteners, texturizers, and/or vitamins. The optional ingredients can be added in any suitable amount. The nutritional products or compositions may be a source of complete nutrition or may be a source of incomplete nutrition.

As used in this disclosure and the appended claims, the singular forms "a," "an" and "the" include plural referents unless the context clearly dictates otherwise. Thus, for example, reference to "a polypeptide" includes a mixture of two or more polypeptides, and the like.

The present disclosure is directed to package that are designed to be easily handled and/or carried by a consumer. Although known packages contain design elements that make it convenient for a consumer to handle or carry packages, these design elements typically include elements such as, for example, finger grips, ergonomic handles, textured grips, etc. These types of known packages, however, may suffer from certain limitations or pitfalls in the eyes of specific consumers.

Certain consumers such as athletes may be interested in packages that do not require hands to carry the package. For example, an athlete who is participating in, or preparing for, an athletic activity (e.g., running, biking, skating, etc.) may wish to carry a product such as a nutritional composition with him before, during, and/or after the activity, but may not want to carry the product in his hand(s). The product may be, for example, a solid, liquid and/or semi-solid product that is formulated to provide increased carbohydrate loads for improved or sustained athletic performance or increased mental alertness. For this reason, it would be convenient for the athlete to be able to wear a package containing these types of products so that the athlete's hands are free to participate in the athletic activity. Accordingly, the packages of the present disclosure are designed to be wearable by a consumer or user. Further, the packages of the present disclosure may be opened or otherwise accessed using both hands, one hand, or no hands, as will be discussed further below.

Although the packages of the present disclosure are disclosed as being useful for an athlete, it is clear that the packages of the present disclosure can be used by any consumer in need of same. For example, the packages can be useful to house a performance composition and may be worn by athletes. The packages may also be useful to house a snack and may be worn by parents or their children. The packages may further be useful to house a pet treat and may be worn by pet owners or on the collars of pets. Accordingly, the skilled artisan will appreciate that the packages of the present disclosure are not limited to the uses described herein.

The present packages may be worn on a body of, or the clothing of, a consumer for consumption by same, or a caretaker for consumption by another. For example, the present packages can be worn by a consumer or caretaker on a wrist, ankle, leg, arm, waist, neck, head, finger, or combinations thereof. Alternatively, the present packages can be worn on the clothing of a consumer or caretaker, the clothing including, but not limited to, a watch, a belt, a necklace, a ring, a shoe, a headband, a wristband, or combinations thereof. The skilled artisan will appreciate, however, that the body parts and clothing pieces listed herein are not limiting and the present packages may be worn on any convenient location on a consumer.

Figure 2:
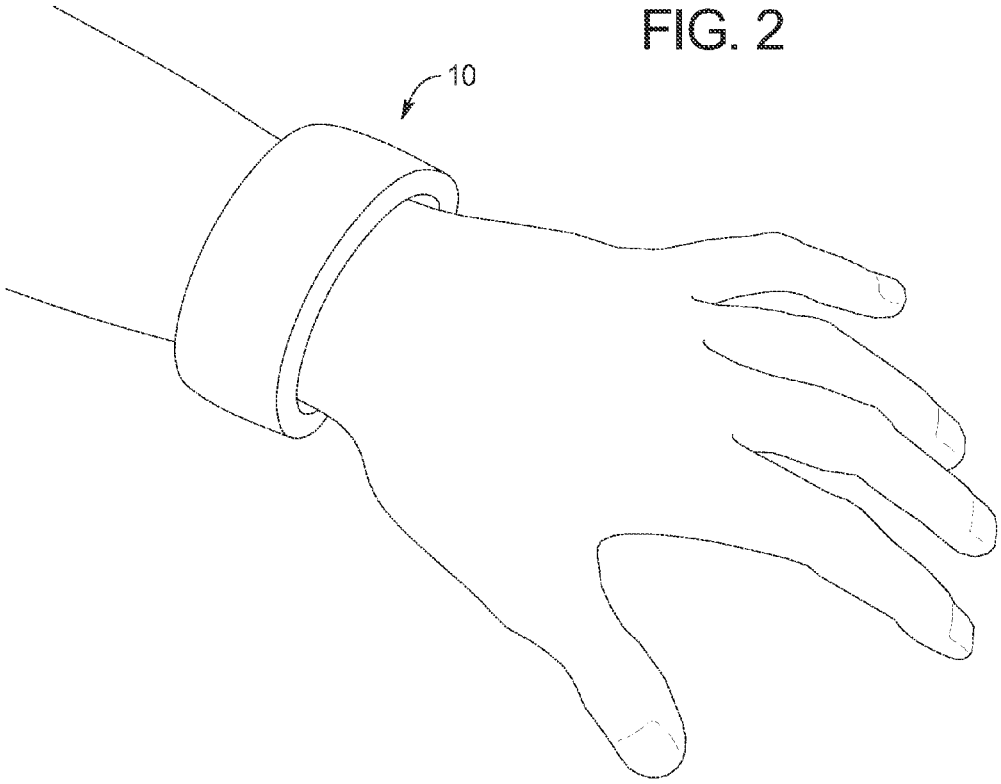
FIG. 2 is a perspective view of a package worn by a user in accordance with an embodiment of the present disclosure.

The packages of the present disclosure may be provided in several useful forms to the consumer. In a first embodiment, and as shown in FIG. 1, a package 10 may be provided in the form of a flexible bracelet that is designed to be worn on the wrist of a consumer, as shown in FIG. 2. In this embodiment, package 10 may be, for example, a flexible bracelet having a first compartment 12 for housing a product, and a second compartment 14 for providing structure to make package 10 wearable.

Package 10 is so constructed and arranged to fit comfortably on, for example, a wrist or ankle of a consumer. Package 10 may be, for example, from about 2 to about 10 inches in length, or from about 3 to about 9 inches in length, or from about 4 to about 8 inches in length, or from about 5 to about 7 inches in length, or about 6 inches in length. Similarly, package 10 may be from about 0.5 to about 4 inches in width, or from about 1 to about 3 inches in width, or about 2 inches in width. The skilled artisan will appreciate that the thickness of package 10 will depend upon the type of product or the volume of product contained in product compartment 12. In this regard, product compartment 12 will be thicker if it is designed to house larger solid products and product compartment 12 will be thinner if designed to house a liquid product.

Product compartment 12 may have any volume capable of housing a consumable product, while still being convenient for wearing of the package by a consumer. For example, product compartment 12 may have a volume ranging from about 0.5 ounces to about 5 ounces, or from about 1 ounce to about 4 ounces, or from about 2 ounces to about 3 ounces, or about 2.5 ounces, or about 1.4 ounces.

Product compartment 12 may also be a sealed compartment. The sealing may be irrevocably sealed or resealable. This feature will help to maintain the freshness of any consumable product stored in product compartment 12.

Product and structure compartments 12, 14 may be made of any flexible material that is configured to hold solids, liquids and/or semi-solids. For example, product and structure compartments 12, 14 may be made of a flexible plastic, a flexible fabric, or the like, or combinations thereof. Product and structure compartments 12, 14 may be individually manufactured and adjoined in a later manufacturing step. Alternatively, product and structure compartments 12, 14 may be created from one, single piece of flexible material. Accordingly, the skilled artisan will appreciate that any number of product compartments 12 may be used in combination with structure compartment 14. For example, package 10 may include one, single structure compartment 14 to provide structure to package 10 that allows the package to be wearable, which may be combined with any number of product compartments 14 that can house a product. In this regard, package 10 may include one, two, three, four, or more product compartments 14, each compartment containing the same or different types and/or volumes of products, as will be described further below. In embodiments containing more than one product compartment 12, the product compartments may be located on either side of structure compartment 14.

As shown in FIG. 1, product compartment 12 and structure compartment 14 are located contiguous to each other such that product compartment 12 and structure compartment 14 are in contact with each other to form one, integral package. This structure helps to ensure that the integrity of package 10 remains throughout the wearing of package 10 by a user.

Figure 3:
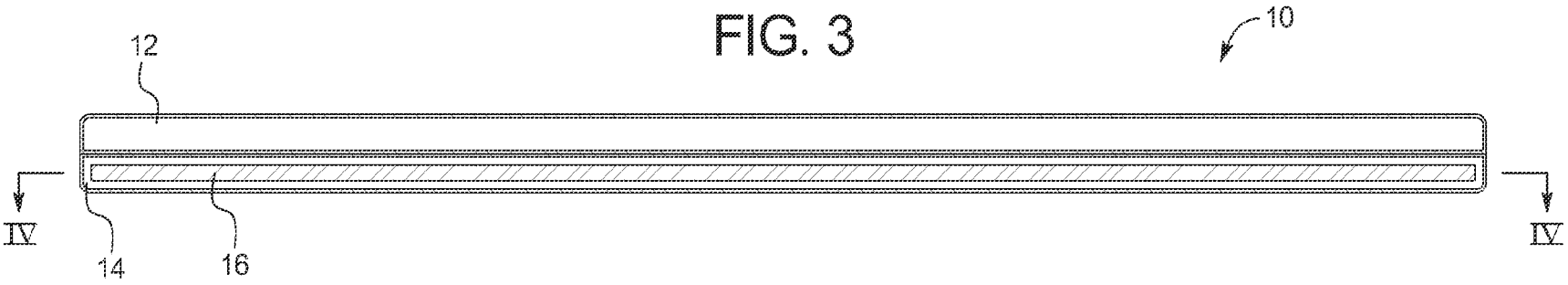
FIG. 3 is a cross-sectional view of the package of FIG. 1 in accordance with an embodiment of the present disclosure.
Figure 4:
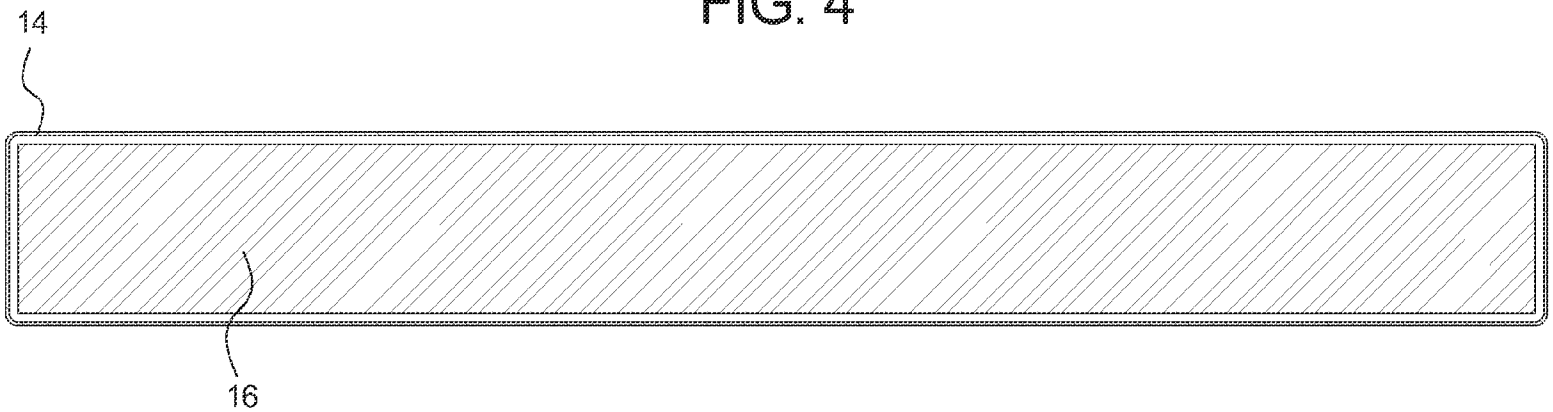
FIG. 4 is a cross-sectional view of the package of FIG. 3 in accordance with an embodiment of the present disclosure.

In an embodiment, package 10 may be a slap bracelet. As used herein, a "slap bracelet" is a bracelet having a layered, flexible metal bi-stable spring band contained within a flexible housing (e.g., fabric, plastic, etc.). A slap bracelet can be straightened out to create tension within the metal band, and then slapped against the wearer's wrist, causing the band to spring back into a curve that wraps around the wrist securing the bracelet to the wearer. In this embodiment, product compartment 12 may house a consumable product such as, for example, an athletic performance product (e.g., a carbohydrate gel, a carbohydrate liquid, a carbohydrate solid, etc.), while structure compartment 14 includes a bi-stable metal spring band 16, as shown by FIGS. 3 and 4. Although packages 10 of the present disclosure are described as having a bi-stable metal spring band 16 in one embodiment, the skilled artisan will appreciate that any material that behaves as a bi-stable metal spring band may also be used (e.g., a plastic band) instead of a metal band.

Regardless of the material used to form the bi-stable band, the bi-stable band should be sized and shaped to provide the integrity necessary to make the present packages wearable. For example, the bi-stable band may be a substantially flat band that ranges from about 1 inch to about 10 inches in length, or from about 2 to about 9 inches, or from about 3 to about 8 inches, or from about 4 to about 7 inches, or from about 5 to about 6 inches. Bi-stable band may also have a width that ranges from about 0.5 inches to about 4 inches, or from about 1 inch to about 3 inches, or about 2 inches. The skilled artisan will appreciate that, depending on the embodiment of the present packages, the bi-stable band may be sized and shaped to be accepted by an opening in package 10.

Metal band 16 may be formed within structure compartment 14 during manufacturing such that package 10 is sold to a consumer having a product in product compartment 12 and metal band 16 in structure compartment 14. Alternatively, in another embodiment illustrated in FIG. 5, package 10 may be manufactured having an opening 18 for structure compartment 14 designed to receive metal band 16 after manufacturing. A consumer may then be able to slide metal band 16, for example, into opening 18 prior to use of package 10 to obtain the same wearable properties as packages 10 manufactured with metal band 16 formed within structure compartment 14. In this embodiment, it is possible to market package 10 for use with a reuseable metal band 16, which could reduce costs for consumers who could use package 10 of FIG. 5 with a previously purchased metal band 16 and a new product compartment 12. Alternatively, package 10 may include metal band 16 formed therein and a refillable product compartment 12 such that a consumer can purchase additional product(s) to place in product compartment 12 for use as a wearable package. Again, this could reduce costs for consumers who could buy additional product(s) at a lower cost than the cost for purchasing an entire package 10.

In another embodiment, package 10 may also be designed as a flexible, continuous band that can be, for example, slid over a user's hand and be worn as a bracelet. In this embodiment, package 10 may include a connector or clasp (not shown) that can be used to connect two portions of package 10 to clasp package 10 around the wrist or other body part of a user (e.g., ankle, neck, waist, head, etc.).

Figure 5:
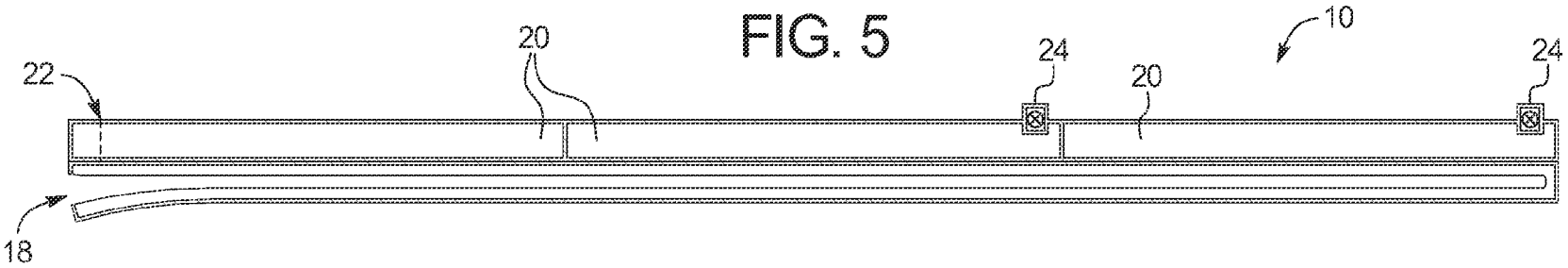
FIG. 5 is a cross-sectional view of a package similar to the package of FIG. 1 in accordance with an embodiment of the present disclosure.
Figure 6:
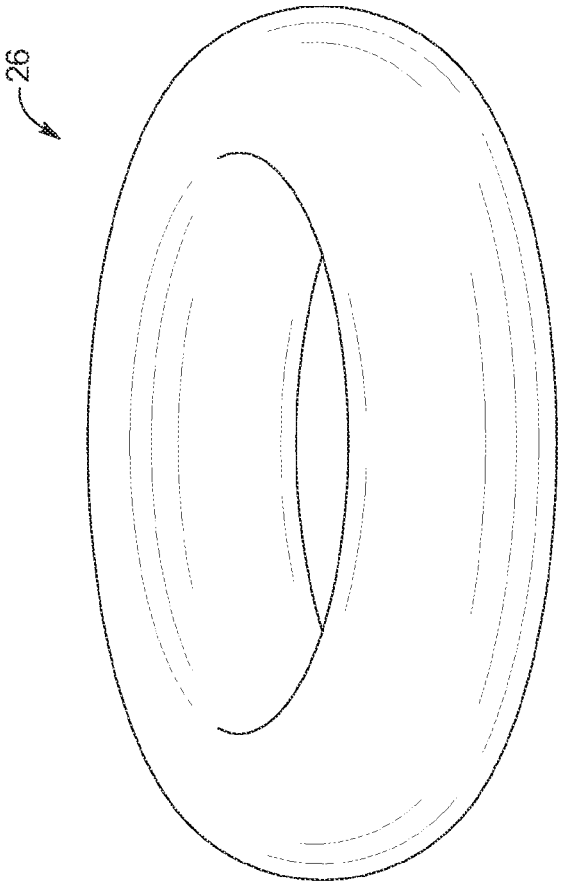
FIG. 6 is a perspective view of a package in accordance with an embodiment of the present disclosure.
Figure 7:
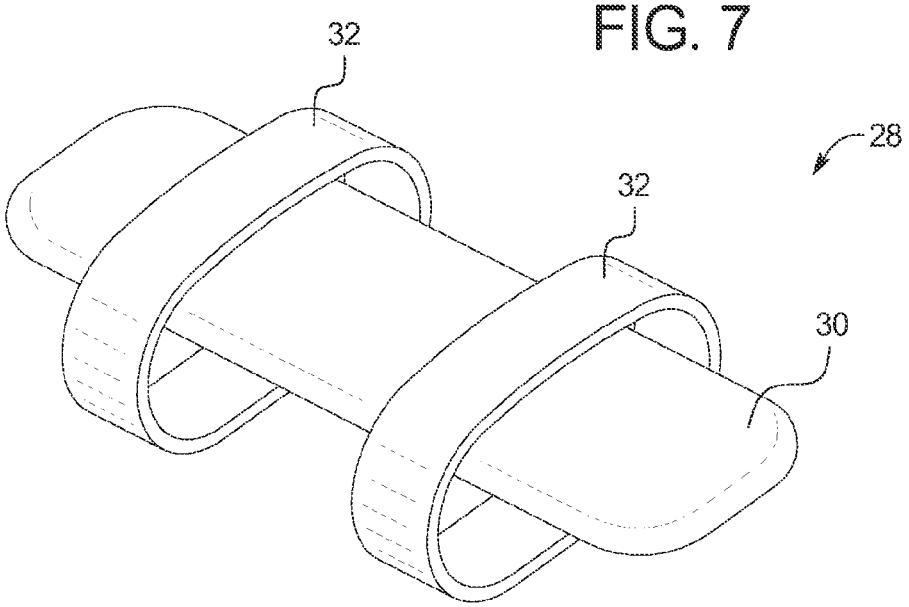
FIG. 7 is a perspective view of a package in accordance with an embodiment of the present disclosure.
Figure 8:
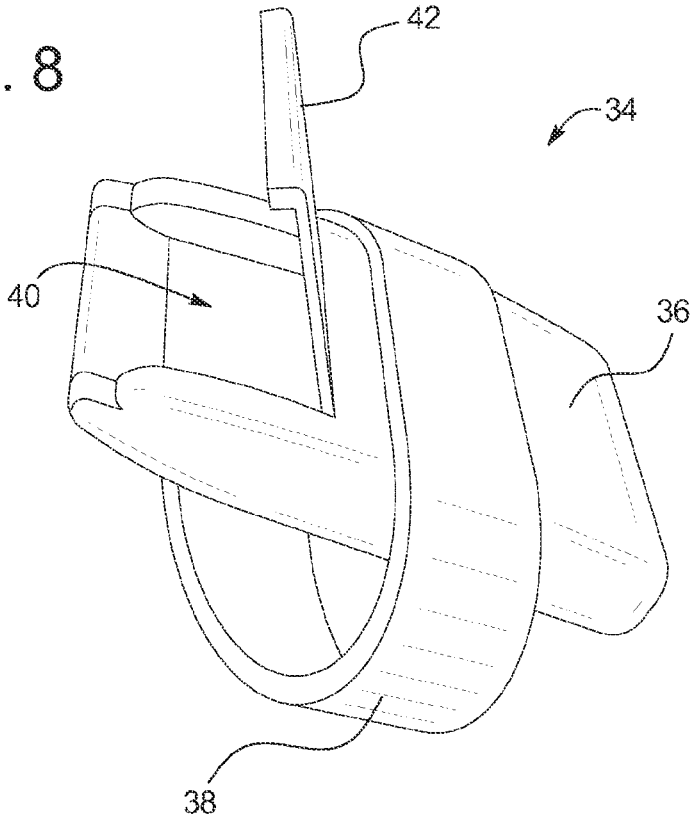
FIG. 8 is a perspective view of a package in accordance with an embodiment of the present disclosure.

As shown in FIG. 5, product compartment 12 may be divided into two or more compartments 20 to house products. Compartments 20 may be equally or differently sized depending on the goal of the product provided. For example, compartments 20 may be of equal or different sizes to provide multiple doses of the same and/or different product to a consumer. For example, a first compartment 20 may be of a first size and may house a first product intended to be consumed by an athlete prior to the athletic performance. A second compartment 20 may be of a second size and may house a second product intended to be consumed by an athlete during the athletic performance. A third compartment 20 may be of a third size and may house a third product intended to be consumed by an athlete after the athletic performance. Alternatively, first, second and third compartments 20 may be equally sized but contain different products, or may be differently sized and contain different amounts of the same product. The skilled artisan will appreciate that any combinations of compartment sizes and products contained therein may be used with the present packages depending on the needs or goals of providing same.

In the same regard, compartments 20 may be sized to provide specific dosing amounts of a specific product to a consumer depending on recommended dosing requirements for a specific activity. For example, if it is recommended that an adult male engaged in the sport of running consume a certain amount of carbohydrates before, during and after a run, compartments 20 may be sized to provide the specific dosing amounts required by the adult male. Accordingly, packages 10 may be marketed to target a specific gender, a specific sport, a specific use, or any combinations thereof. Alternatively, multiple doses of a product can be achieved by providing multiple packages 10 to be worn by a user. In this regard, two or more packages 10 may be worn by a user, the two or more packages 10 containing the same or different types of products and/or the same or different amounts of products.

Package 10 is so constructed and arranged to be easily opened by a consumer to empty the contents therein. For example, to access any product contained within product compartment 12, a user may open product compartment 12 by cutting, tearing, puncturing or removing a portion of the wrapping and emptying the contents of same. For example, and as shown by FIG. 5, package 10 may include a perforated portion 22 which a consumer may use to bite or tear open to access products contained in product compartment 12. Alternatively, product compartment 12 may include a one-way valve 24 that can be bit or sucked by a consumer to access products contained in product compartment 12. Because packages 10 can be worn by a consumer, and any product contained in product compartment 12 accessed, for example, by hand or mouth, packages 10 provide for easy two-, one- or no-handed access to products contained therein. The products may then be accessed using one or both hands or may be dispensed directly into a consumers mouth. This may be advantageous for a consumer who is not readily able to use one or both of his hands to open a package and access consumable products (e.g., a runner during a marathon, a bicyclist during a race, etc.).

Package 10 may also include branding and/or product indicia on any exterior surface (not shown). The indicia may be printed thereon or adhered thereto with a sticker, adhesive label, etc. In this manner, package 10 may be designed to sit upright for display on a retail shelf, or to hang from a product display rack.

In another embodiment, a rigid, wearable package 26 is provided. Similar to packages 10 described herein above, package 26 may be worn by a consumer for easy carrying of a product (not shown) that is housed within package 26. In this embodiment, package 26 may be one integral package that can be slipped over a user's wrist, ankle or other body part to wear as a bracelet. Alternatively, package 26 may also include a clasp (not shown) to clasp together two portions of package 26 to be worn on the wrist or other body part of a user (e.g., ankle, neck, waist, head, etc.). As with package 10, products contained within package 26 may be accessed by cutting, tearing, biting, ripping or removing any portion of package 26. Similarly, one-way valves or similar devices (not shown) may also be used to access any product contained in package 26. The skilled artisan will appreciate that all of the characteristics described above with respect to package 10 may also be utilized with package 26. For example, package 26 may be refillable, reusable, contain multiple product compartments, include valves, perforations and/or clasps, irrevocably sealed, etc.

In yet another embodiment of the present disclosure, a flexible container 28 is provided and includes a product compartment 30 and at least one attachment apparatus 32. Product compartment 30 may be any flexible compartment capable of containing a solid, liquid, and/or semi-solid product. In an embodiment, product compartment 30 is flexible plastic. Attachment apparatus 32 may be, for example, a strap, a fastener, a connector, a tie, a belt, a band, a leash, a strip of material, an adhesive, a buckle, a button, etc. In an embodiment attachment apparatus 32 is sized and shaped to attach to an existing article of clothing such as, for example, a watch band, a belt, a scarf, a shoe, a bracelet, a necklace, a ring, a headband, a wristband, etc. Attachment apparatus 32 may be a continuous piece of material such that attachment apparatus 32 may be slid onto, for example, a watch band to be worn by a user. Alternatively, attachment apparatus 32 may use Velcro, a button, a clasp, etc. to connect two portions of attachment apparatus 32 to wrap around, for example, a belt, to be worn by a user.

As with package 10, products contained within package 28 may be accessed by cutting, tearing, biting, ripping or removing any portion of package 28. Similarly, one-way valves or similar devices (not shown) may also be used to access any product contained in package 28. The skilled artisan will appreciate that all of the characteristics described above with respect to package 10 may also be utilized with package 28. For example, package 28 may be refillable, reusable, contain multiple product compartments, include valves, perforations and/or clasps, etc.

In yet another embodiment of the present disclosure, a rigid container 34 is provided and includes a product compartment 36 and at least one attachment apparatus 38. In an embodiment, product compartment 36 is a solid compartment including an opening 40 to access product(s) contained in product compartment 36, and a lid 42 to close product compartment 36. Product compartment 36 may be any rigid compartment capable of containing a solid, liquid, and/or semi-solid product. In an embodiment, product compartment 36 is rigid plastic. Attachment apparatus 38 may be, for example, a strap, a fastener, a connector, a tie, a belt, a band, a leash, a strip of material, an adhesive, a buckle, a button, etc. In an embodiment attachment apparatus 38 is sized and shaped to attach to an existing article of clothing such as, for example, a watch band, a belt, a scarf, a shoe, a bracelet, a necklace, a ring, a headband, a wristband, etc. Attachment apparatus 38 may be a continuous piece of material such that attachment apparatus 38 may be slid onto, for example, a leash to be carried by a pet owner. Alternatively, attachment apparatus 38 may use Velcro, a button, a clasp, etc. to connect two portions of attachment apparatus 38 to wrap around, for example, a shoe, to be worn by an athlete.

As with package 10, products contained within package 34 may be accessed by cutting, tearing, biting, ripping or removing any portion of package 34. Similarly, one-way valves or similar devices (not shown) may also be used to access any product contained in package 34. The skilled artisan will appreciate that all of the characteristics described above with respect to package 10 may also be utilized with package 28. For example, package 34 may be refillable, reusable, contain multiple product compartments, include valves, perforations and/or clasps, irrevocably sealed, etc.

Methods for using packages of the present disclosure are also provided. In an embodiment, methods for administering a product to a consumer are provided, as well as methods for consuming a product on-the-go, administering a pet treat to a pet, administering a snack to a child, providing nutrition to an athlete, enhancing a performance of an athlete, and improving a recovery of an athlete after an athletic event such as running, biking, skating, skiing, etc. The skilled artisan will appreciate, however, that there are many other potential uses of the present packages including, for example, providing increased carbohydrate loads to an athlete before, during or after an athletic event, improving the performance of an athlete before, during or after an athletic event, etc. In an embodiment, nutritional kits are also provided.

The packages of the present disclosure provide a convenient, portable and easy-to-consume way to deliver a product to a consumer. The packages can be worn by a consumer and can provide easy, two-, one- or no-handed access to products contained therein. In addition, the packages may be designed to provide precise product dosing requirements to a specific consumer.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A wearable package, comprising:

a flexible container defining a first compartment and a second compartment, the flexible container having a length and a width;

a food product positioned within the first compartment; and a bi-stable band positioned within the second compartment, the bi-stable band moveable between a straight position wherein the flexible container conforms to the contour of the bi-stable band so as to be supported in a flat orientation and a coiled position wherein the flexible container conforms to the contour of the bi-stable band so as to be positionable around the wrist of a consumer, wherein the first compartment is sealed in a way that the food product is sealed within the first compartment and the second compartment is sealed relative to the first compartment.

2. The package according to claim 1, further comprising a one-way valve positioned in the flexible container in fluid communication with the first compartment to access the food product within the first compartment when the one-way valve is operated from a closed position to an open position.

3. The package according to claim 1, wherein the flexible container is from about 2 to about 10 inches long.

4. The package according to claim 1, wherein the flexible container is from about 0.5 to about 4 inches in width.

5. The package according to claim 1, wherein the first compartment has a volume from about 1 ounce to about 4 ounces.

6. The package according to claim 1, wherein the food product is at least one of a solid product, a liquid product, and a semi-solid product.

7. The package according to claim 1, wherein the first compartment is divided into at least two separate portions, and wherein the food product is positioned within each of the separate portions.

8. The package according to claim 1, wherein the flexible container is provided with a line of perforations along a portion thereof in a way that the first compartment is accessed by tearing the flexible container along the line of perforations.

9. The package according to claim 1, wherein the first and second compartments are contiguous.

10. The package according to claim 7, further comprising a plurality of one-way valves positioned in the flexible container in fluid communication with each of the portions of the first compartment to access the food product within the separate portions of the first compartment when the one-way valves are operated from a closed position to an open position.

11. The package according to claim 7, wherein the flexible container is provided with a plurality of lines of perforations along a portion thereof in a way that the separate portions of the first compartment are accessed by tearing the flexible container along the lines of perforations.

12. The package according to claim 7, wherein the separate portions of the first compartment are equal in size.

13. The package according to claim 7, wherein the separate portions of the first compartment are different in size.

14. The package according to claim 1, wherein the first compartment is irreversibly sealed.

15. The package according to claim 1, wherein the first compartment is reversibly sealed.

16. A method for administering a product to a consumer, the method comprising:

providing a wearable package comprising a first compartment with a food product sealed therein and a second compartment sealed relative to the first compartment and housing a bi-stable band, the bi-stable band moveable between a straight position wherein the package conforms to the contour of the bi-stable so to be supported in a flat orientation and a coiled position wherein the package conforms to the contour of the bi-stable band so to be positionable around the wrist of a consumer;

positioning the package around the wrist of the consumer by causing the bi-stable band to move to the coiled position with the bi-stable band positioned between the wrist of the consumer and the food product;

breaking the seal of the first compartment;

removing the food product from the first compartment; and consuming the food product.

17. The method according to claim 16, wherein the first compartment is divided into at least two separate portions, wherein the food product is divided between the separate portions, and wherein the step of breaking the seal comprises tearing the package at a location corresponding to a selected one of the separate portions.

18. The method according to claim 16, wherein the step of breaking the seal comprises tearing the package.

19. The method according to claim 16, wherein the step of breaking the seal comprises tearing the package along a line of perforations.

20. The method according to claim 16, wherein the step of breaking the seal comprises opening a one-way valve positioned in the package in fluid communication with the first compartment.

* * * * *